United States Patent [19]

Horowitz

[11] 4,220,096

[45] Sep. 2, 1980

[54] BOGIE

[75] Inventor: Alexandre Horowitz, Eindhoven, Netherlands

[73] Assignee: Varitrac AG, Zug, Switzerland

[21] Appl. No.: 879,829

[22] Filed: Feb. 21, 1978

[30] Foreign Application Priority Data

Oct. 21, 1977 [NL] Netherlands ..... 7701814

[51] Int. Cl.[2] ..... B61F 5/00; B61F 3/02

[52] U.S. Cl. ..... 105/163 R; 105/180; 105/183

[58] Field of Search ..... 105/163 R, 157 R, 148–156, 105/180, 183, 161, 216–218, 223, 225, 195, 196

[56] References Cited

U.S. PATENT DOCUMENTS

| | | | |
|---|---|---|---|
| 213,840 | 4/1879 | Schroeder | 105/217 |
| 907,964 | 12/1908 | Brown | 105/163 R |
| 1,179,798 | 4/1916 | Briggs | 105/180 |
| 1,635,910 | 7/1927 | Tucker | 105/183 |
| 3,827,373 | 8/1974 | Mouneydiere | 105/183 |

*Primary Examiner*—L. J. Paperner
*Assistant Examiner*—Lawrence E. Williams
*Attorney, Agent, or Firm*—Blanchard, Flynn, Thiel, Boutell & Tanis

[57] ABSTRACT

A wheel-bogie for supporting a crane, said bogie comprising a load-carrying foot, a main frame, at least two intermediate frames and a number of wheel frames; the transfer of the load from the foot to the main frame and from said frame to the intermediate frames and then to the wheel frames is effected by means of line contact occuring between two cooperating cylindrical planes with different radii of curvature.

17 Claims, 12 Drawing Figures

BOGIE

BACKGROUND OF THE INVENTION

The invention relates to a bogie for supporting and guiding a heavy implement movable on rails, such as a crane, which bogie is made up of a number of wheels which always cooperate in pairs in a wheel frame, while the load to be supported bears on these wheel frames uniformly divided through a supporting foot, a main frame and intermediate frames, if any. Owing to the use of a bogie or pair of wheels of this type, which is used for for instance, displacing a crane, the total load bearing on the wheels is thus uniformly divided over a number of wheels. For this purpose mostly horizontal axes are applied so that the assembly is rather expensive and a regular maintenance is required.

SUMMARY OF THE INVENTION

The invention aims to provide a simplified structure whereby an efficient subdivision of the total load over any number of wheels may be achieved due to the application of elements to be manufactured easily and at low cost. According to the invention, this aim is attained in that the transfer of the load from the supporting foot to the main frame and from there to the wheel frames via intermediate frames, if any, is always carried out by means of a line-contact between at least one pair of cylindric planes having a different radius of curvature which contact each other. As a result of these features, each pivotal axis is formed by the contact-line which, naturally, is displaced during relative tilting of the contact plane. Since the displacement distance as compared with the wheel distance is negligible and the rolling resistance is very slight, such a support may bring about a very good compensation of the load differences, if any, arising in individual wheels.

The use of contact-lines for supporting the intermediate frames may lead to very compact and efficient structures. Problems may occur, however, such as directing the contact-line. In view hereof, according to the invention, a toothing is provided on both ends of the contact line between each pair of cylindrical planes, the pitch circle of which coincides with the cylindric plane concerned.

Each toothing comprises two cooperating tooth segments whereby at least one of the two segments is adjustable transversely on to the contact line in a horizontal direction. As a result thereof, it is not necessary to carry out a preliminary determination of the exact position in the course of manufacturing; this may be done after the assembling of the bogie. The cooperating tooth segments may, moreover, consist of a single tooth in combination with a single recess.

Should any horizontal forces occur, i.e. forces in the direction of the contact-line, the tooth segments can have a shape such, that they also limit any displacement in the direction of the contact-line. Should, moreover, the contacting cylindric planes have a risk of loosing contact, the tooth segments can be so shaped that they are linked together in a direction perpendicular to the cylindric planes, as measured from the contact-line.

So far, a pair of cylindrical planes with a different radius of curvature supporting each other, has been mentioned, but the radius of curvature of one of the two cylindric planes may be infinite, which means that a flat plane is concerned. Such an embodiment also contributes to a low cost expenditure. In the latter case, only the portion of the toothing located above the flat plane is needed.

The bogie described so far is particularly suitable for applications in which the contact lines are to have a permanently adjusted direction, like in the case of the support of slewing cranes on a flat circular rail track. In this case, in fact a central bearing is used for measuring the radial forces. A similar additional guide may also be provided in a straight double-rail track.

The invention also relates to a bogie in which the guiding along the rail is provided for double-flanged wheels. In that case, the cylindric planes contacting each other are formed by disc-shaped roller bodies located spaced from each other, two cylindrically curved opposite edges cooperating with two flat parallel planes of the relating bogie elements by means of a line-contact, said roller bodies being coupled to each other pivotally, through a connecting element positioned transversely on the running direction.

SURVEY OF THE DRAWINGS

DESCRIPTION OF PREFERRED EMBODIMENTS

Figure 1:
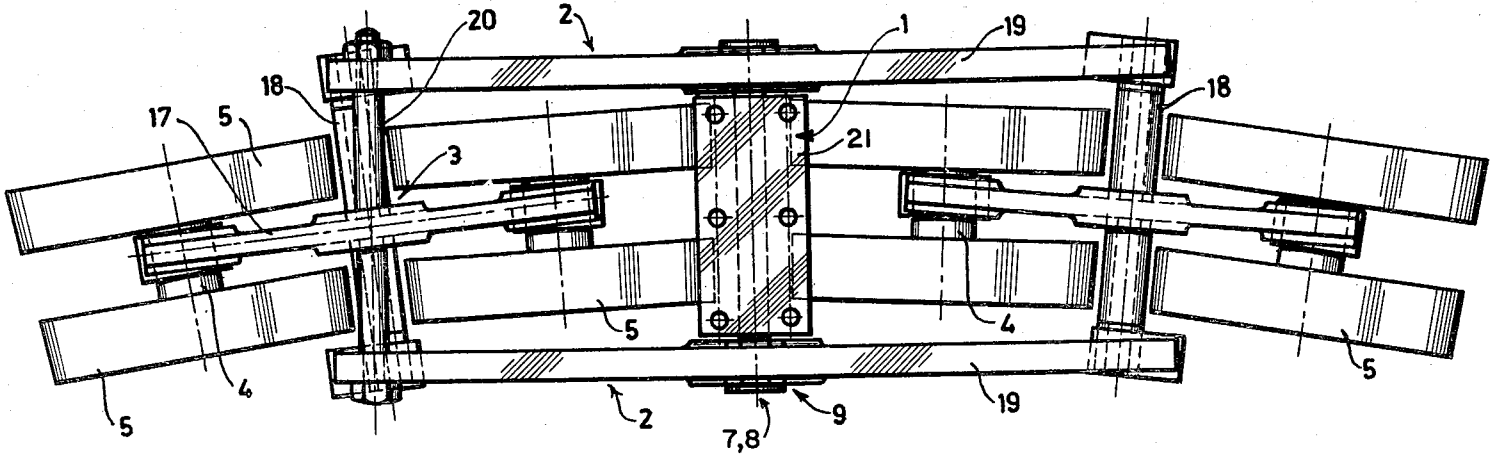
FIG. 1 shows a top view of the bogie according to a first variant.

The variant of the bogie shown in FIG. 1–6 comprises a supporting foot 1 on which the load of the heavy implement to be supported, for instance a slewing crane bears with a capacity of, for example, 3000 tons; the bogie further comprises a main frame 2 and two cross-shaped intermediate frames 3. Four wheel frames 4 each bear two wheels 5. As can be seen in the drawings, the load is transferred through the supporting foot 1 to the main frame 2 from there to the two intermediate frames 3 and subsequently to the wheel frames 4, and finally on the eight wheel 5 of this bogie. In all connections between the consecutive elements of the bogie a certain angular displacement is possible, in order to obtain a uniform repartition of the load over all of the available wheels 5 and from there on the rail track 6.

The transfer of the load from the supporting foot 1 to the main frame 2 and subsequently through the intermediate frames 3, to the wheel frames 4 is brought about in each instance by means of line contact between a pair of cylindric surfaces or planes 7 and 8 with a different radius of curvature supporting each other. This radius of curvature is infinite for surface 8 which means that this element is a flat surface. The element 7, to the contrary, has a limited radius of curvature and is, therefore, a curved surface. This line-contact replaces the conventional pivotal axes which are used when constructing bogies. Said substitution is made possible since the occuring angular displacement in the case of heavy cranes is very little. Cranes of this type move according to a straight track or a fixed circular track. The contact-line between the planes 7 and 8 constitutes the pivotal axis which, displaces during the tilting of the elements. The distance of displacement as compared with the wheel distance is negligible and the rolling resistance is very slight. As a result such a support may cause a very good compensation of load differences, if any, occurring between the wheels mutually or between pairs of wheels.

Figure 4:
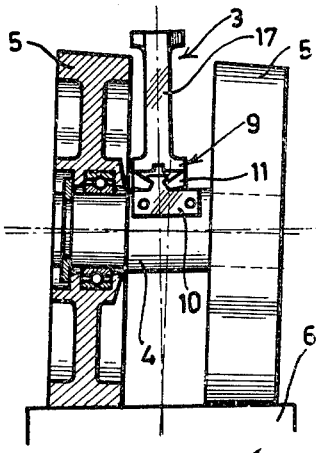
FIG. 4 shows an axial cross section of a wheel frame with a pair of wheels thereon.
Figure 5:
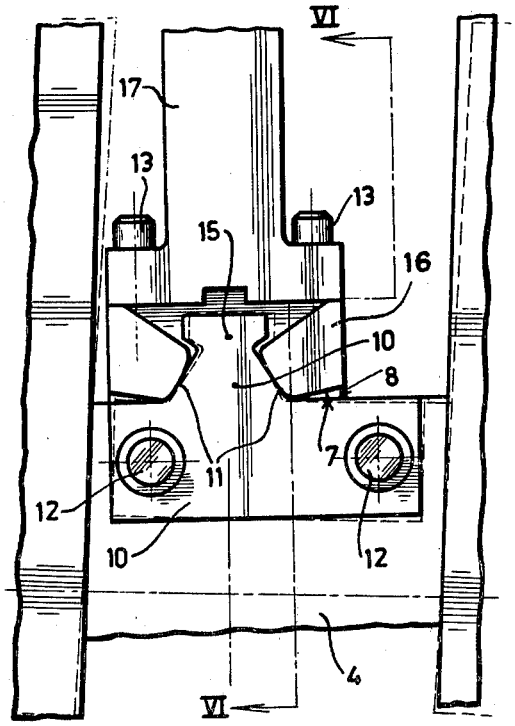
FIG. 5 shows a detail of FIG. 4 on an enlarged scale.
Figure 6:
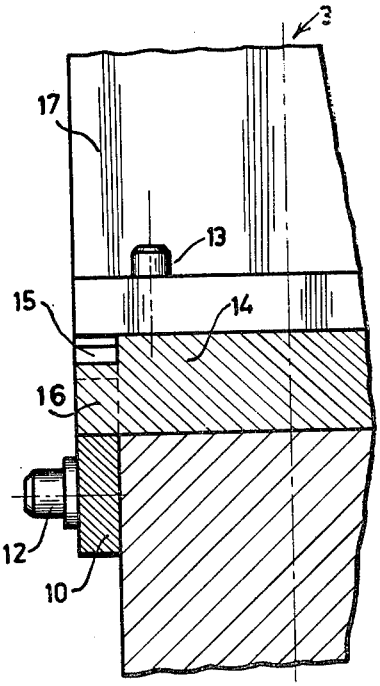
FIG. 6 shows a cross section of the detail of FIG. 5.

For directing the contact line, an adjustable toothing 9 is provided on both ends of this line, this toothing being shown in FIGS. 4 and 5 for the transition between an intermediate frame 3 and a wheel frame 4. The pitch circle of the toothing coincides with the cylindrical face of the curved surface 7. The toothing 9 comprises two cooperating tooth segments 10 and 11, segment 10 of which being adjustable in a direction transversely to the contact-line. As can be seen in FIGS. 4 and 5, the segments 10 and 11 consist of one single tooth in combination with one single recess.

For absorbing any horizontal forces, in the direction of the contact-line between the planes 7, 8 which support each other, a covering plate is fixed near the ends of one of the planes 7 and 8 which plate also overlaps the other plane. In the embodiment according to the first bogie variant, this is done at the point of transition between the intermediate frame 3 and the wheel frame 4 by the tooth segment 10 itself. This segment 10 is adjustably mounted upon the wheel frame 4 by means of two bolts 12, while block 14 is fastened by bolts 13 against the intermediate frame 3 and is provided with the curved surface 7. The tooth segments 10, 11 limit any displacement in a direction parallel and perpendicular to the planes 7, 8. In this embodiment the tooth 10 is provided with a head 15. The tooth recess 11 is formed of two converging plate pieces 16. The available intermediate space is sufficient for allowing the maximum deflection (tilting) shown in dotted lines in FIGS. 4 and 5.

The intermediate frame 3 is cross-shaped as seen from the top (FIG. 1) and may be cast. The curved surfaces 7 of this intermediate frame are arranged on blocks 14 both as regards the line of contact between said intermediate frame 3 and the wheel frames 4 and between this intermediate frame 3 and the main frame 2 (see FIGS. 2 and 3). Both sides of the body 17 of each intermediate frame 3 comprise a transversal projection in the center. These projections near the ends, are provided with the raised, cylindrically curved surface 7 of the block 14. The generatrix of this curved plane 7 lies substantially transversely to the running direction of the bogie. The surface 7 cooperates with a downward flat plane 8 at the end of the main frame 2. The projections 18 are plate-shaped and extend up to a slight distance above the rail track 6 so that, in case of a pair of wheels collapsing or derailing, a temporary support for the load is formed after a little vertical displacement, so that no crumbling of the crane may occur.

Figure 2:
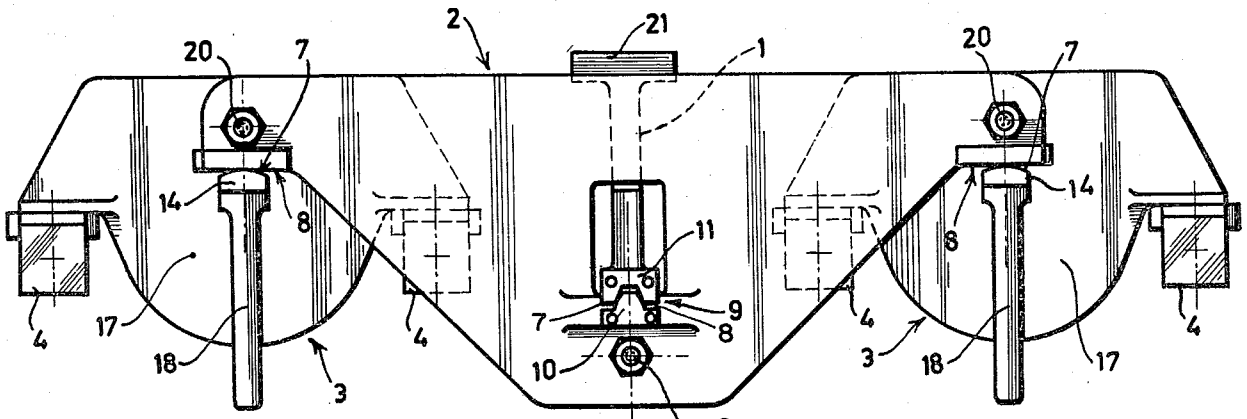
FIG. 2 shows a side view of the main frame of the bogie according to FIG. 1.
Figure 3:
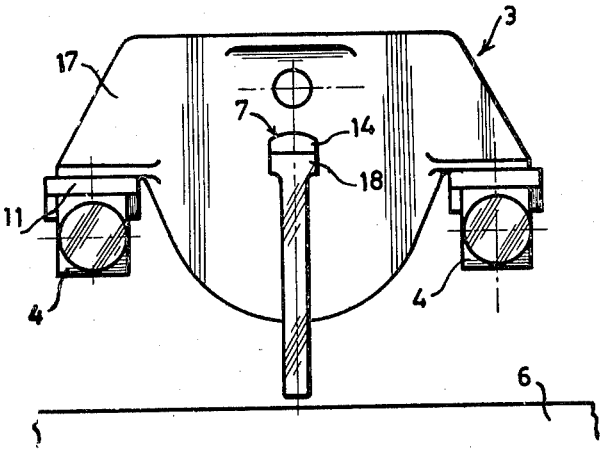
FIG. 3 shows a side view of an intermediate frame of the bogie according to the foregoing Figures.

The main frame 2 comprises two uniform plates 19 which, by means of columns 20, are kept apart (see FIGS. 1 and 2). The central supporting foot 1 is embodied with a table plane 21 on which the load to be supported may be fastened. The lower side the supporting foot is provided with the curved surface 7 which cooperates with the flat plane 8 which is arranged as low as possible between the plates 19 of the main frame 2. On both ends of the contact line between these planes 7 and 8 there is provided the toothing 9, the two segments 10 and 11 thereof being fastened adjustably on respectively the main frame 2 and the supporting foot 1.

At the transition between the supporting foot 1 and the main frame 2 and at the transition between the main frame 2 and intermediate frame 3, the limitation of any displacement in the direction of the contact-line and in the vertical direction may be carried out in the same manner as described above in the case of the transition from the wheel frame 4 to the intermediate frame 3, namely by use of corresponding toothing 9, with its segments 10 and 11 correspondingly arranged with respect to the planes 8 and 7 at each such transition.

Thus, by means of the toothing 9 to match, each contact-line between the pairs of planes 7 and 8 may be adjusted in the correct direction during the erection. This contact-line has then only one degree of freedom, and as regards the function, it is equivalent with the pivotal axis used so far.

The second bogie variant according to FIGS. 7–12 differs from the first variant in so far that no central bearing is provided in the crane for absorbing radial horizontal forces. In the second variant this is done by the application of double-flanged wheels 22. Now, in order to divide these horizontal forces uniformly over the wheels 22, the contact-line between the planes 7 and 8 would have to be capable to rotate also in the contact plane, so that a slip might take place without rollers. In this second bogie variant, this is prevented by using disc-shaped roller bodies 23 (see FIG. 12), the cylindrical sides 7 of which, by means of line-contact, cooperate with two flat parallel planes 8 of the respective bogie elements. In the central position there is a distance d between these planes. Via a connecting element 24 positioned transversely with respect to the running direction of the bogie, the roller bodies 23 are coupled pivotally with each other. Each roller body 23 has, therefore, two contact-lines which are kept in position by means of a toothing 9. With the aid of the connecting element 24 the roller bodies 23 may move freely with respect to each other within certain limits and even the exact parallel position of the two roller bodies may deviate under a little angle. For this purpose, the connecting element 24 cooperates at its ends with the roller bodies 23 via a tenon and mortise joint.

It has still to be observed that the roller bodies 23 may always take up a stable position due to the fact that their radii of curvature are greater than $\frac{1}{2}$ d. As a result thereof, in case of a rotation with respect to the position in which the two contact lines are located in the same vertical, the distance d will always become greater (see FIG. 12).

Figure 7:
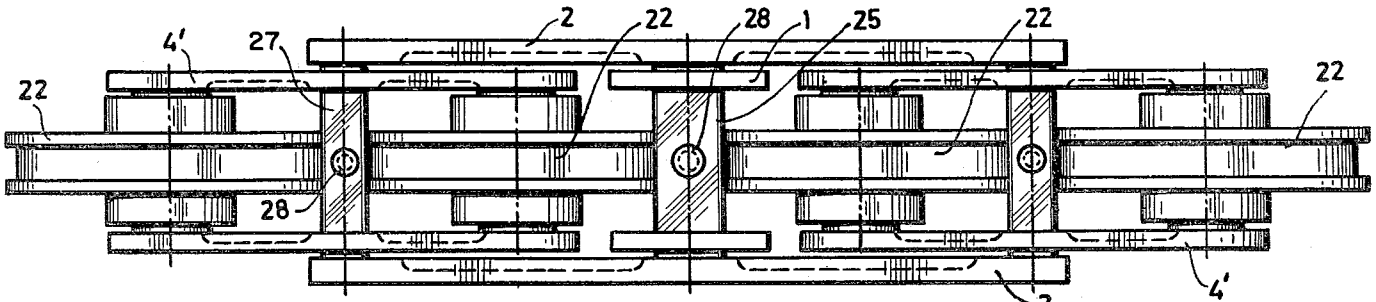
FIG. 7 shows a top view of a portion of a bogie according to a said second variant consisting of a supporting foot, a main frame and two wheel frames.
Figure 8:
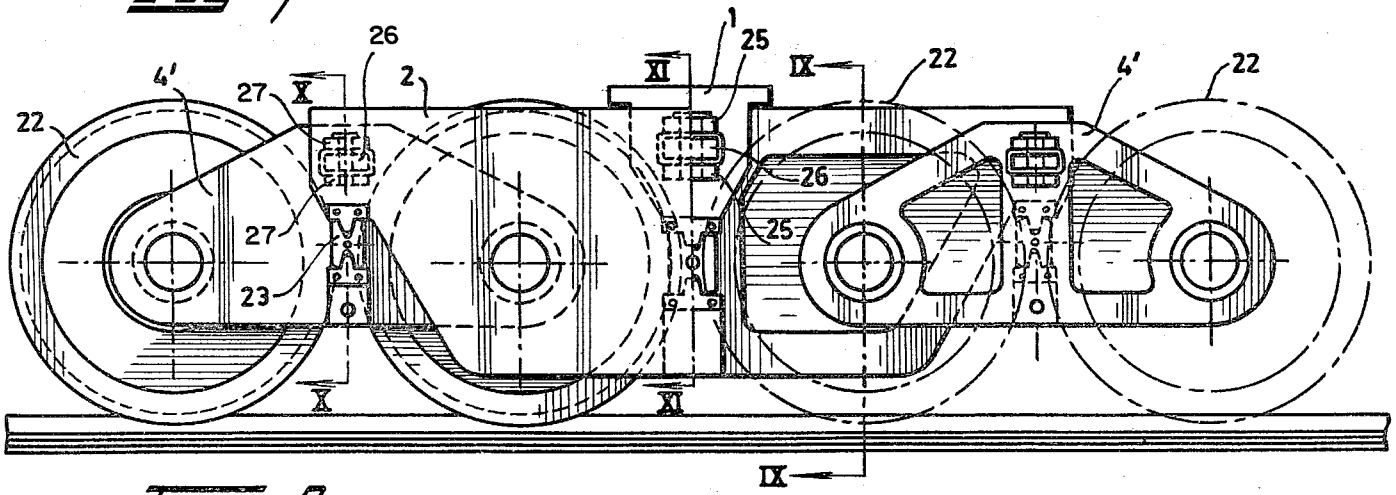
FIG. 8 shows a side view of the bogie according to FIG. 7.
Figure 9:
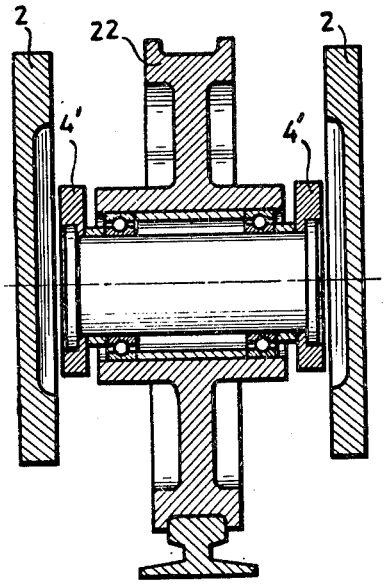
FIGS. 9 and 10 show cross sections of the wheel frame according to the lines IX—IX in FIG. 7 respectively X—X in FIG. 8.
Figure 10:
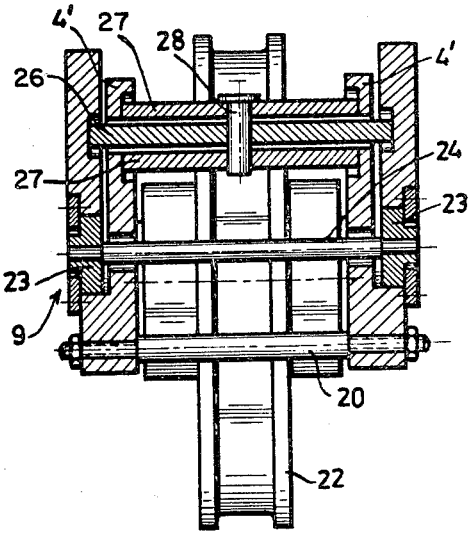
Figure 11:
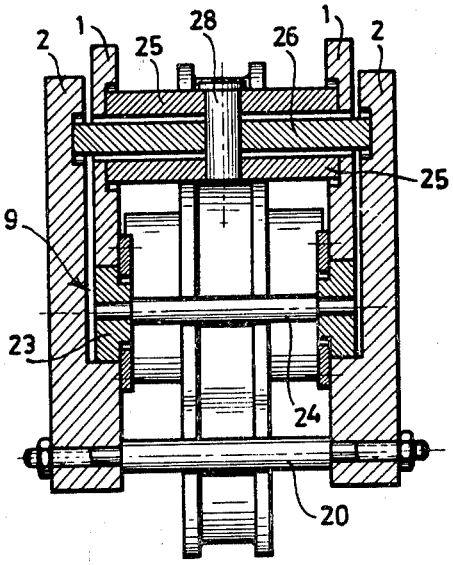
FIG. 11 shows a cross section over the supporting foot and the main frame according to the line XI—XI in FIG. 8.
Figure 12:
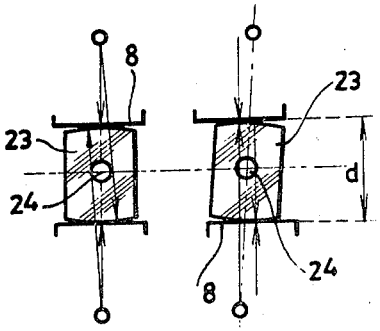
FIG. 12 shows the roller bodies applied in this second variant, in two different positions.

As may be seen from FIG. 7, this bogie variant comprises a supporting foot 1, a main frame 2 and two wheel frames 4'. All these elements are made up of two vertical plate-shaped portions each with one or more supporting planes 8 for a roller body 23. These plates are interconnected by stays 25 for the supporting foot 1, the stays 26 for the main frame 2 and the stays 27 for the wheel frames 4', these stays being positioned parallel above each other. The desired rotating movements between the various bogie elements may now be obtained by means of a coupling between the stays 25 and 26 respectively 26 and 27 with the aid of a perpendicular central joint-pin 28. The shape of this joint-pin or of the surrounding hole-wall is slightly arched so as to allow a slight angular displacement in which nevertheless, a considerable load emanating from driving or braking forces may be taken up. In this embodiment the toothing 9 may be arranged in countersunk position as illustrated in FIG. 10. The segments 10 and 11 are adjustable and are fastened by means of bolts. The toothing 9 serves exclusively to keep the contact-lines in the right positions and no horizontal forces have to be transferred.

Needless to say, the principle according to the invention may be applied to bogies with a number of wheels other than that discussed so far. For instance, in the second variant according to FIG. 7–12, instead of a two-wheeled frame 4', also a four-wheeled frame with oscillating axes may be applied in combination with a double rail track. It is always essential that the support is carried out by means of contact-lines instead of the conventional pivotal axes. In this manner, it is possible to construct a most compact and very light bogie which, provided for a right embodiment, may also be cheap. Finally it is observed that one or more wheels 5 respectively 21 may be driven by means of pinions connected therewith. Particularly in an embodiment with a single rail (FIGS. 7–12) this may be achieved in a very simple manner.

What is claimed is:

1. In a bogie for supporting and guiding a heavy load movable on rails, such as a crane, which bogie includes a number of wheels cooperating in pairs and which are mounted in a wheel frame, and a load supporting foot, and at least one further frame including at least a main frame, for supporting the load in uniformly divided fashion on said wheel frames, the improvement comprising means for transmitting the load through the supporting foot to the main frame and from there to the wheel frames, said transmitting means including a pair of cylindric surfaces of different radius of curvature engaging in line contact, such that the first cylindric surface supports the second cylindric surface, one of said pair of cylindric surfaces being on said main frame, the other of said cylindric surfaces being on the adjacent one of a series of members in load transmitting engagement between said load and wheels, said series of members including said foot, main frame, and wheel frames.

2. The bogie of claim 1, including, on both ends of the contact-line between each pair of cylindric surfaces, a tooth set, the pitch circle of which coincides with the corresponding cylindric surface.

3. A bogie as defined in claim 2, in which each tooth set comprises two cooperating tooth segments, of which at least one of the two tooth segments is adjustable in a direction transverse to the contact-line.

4. A bogie as defined in claim 3, in which the cooperating tooth segments are a single tooth in combination with a single recess.

5. The bogie of claim 3, in which the tooth segments include means for limiting relative displacement of said pair of cylindric surfaces in the direction of the contact-line.

6. The bogie of claim 3, in which the tooth segments include means for limiting relative displacement of said pair of cylindric surfaces in a direction perpendicular to said cylindric surfaces measured from the contact-line.

7. The bogie of claim 1, in which the radius of curvature of one of the two cylindric surfaces is infinite.

8. A bogie as defined in claim 7, including a tooth set comprising a tooth located above said flat infinite radius surface.

9. The bogie of claim 7, including a carriage provided with a number of pairs of wheels arranged on common axes, and additional guiding elements for a guiding along a rail track, said further frames including an intermediate frame provided at both ends with a cylindrically curved surface of which the generatrix lies substantially transverse to the running direction of said carriage, said cylindrically curved surface resting on a flat top on a said wheel frame comprising a single axis.

10. The bogie of claim 8, including a transverse projection provided in the center on both sides of the body of each intermediate frame, having an adjustable plane directed upward and curved cylindrically, of which the generatrix stands substantially transversely to the running direction of the carriage, this surface cooperating with a downward directed flat plane at the end of the main frame.

11. The bogie of claim 1, in which said wheels are double flanged and the guiding along the rail is effected by said double-flanged wheels, said foot, wheel frames and further frames being elements of said bogie, the cylindric surfaces comprising disc-shaped roller bodies spaced from each other and each having two opposite cylindrical edges cooperating, by means of line-contact, with two flat parallel supporting surfaces of the respective said bogie elements between which the load is to be transferred, these roller bodies being coupled pivotally with each other by a connecting element positioned transversely to the running direction of the bogie.

12. A bogie as defined in claim 10, in which the connecting element connects at its ends to the roller bodies via a tenon and mortise connection.

13. The bogie of claim 10, including a tooth set at the contact line between a said roller body and flat surface in which the tooth pitch is countersunk in a side of the roller body.

14. The bogie of claim 10, provided with two said wheel frames, both the supporting foot and the main frame as well as the wheel frames comprising two vertical plate-shaped portions each with one or more said supporting surfaces for engaging a roller body, said vertical plate-shaped portions being connected by stays located in parallel above each other, a perpendicular central pivoting pin between the stays of the supporting foot and the center of the main frame and between the stays of each wheel frame and the respective end of the main frame.

15. A bogie as defined in claim 13, in which the radius of curvature of the cylindric surfaces of the roller bodies is greater than half the distance between the supporting surfaces so that a stable center position of these roller bodies is obtained.

16. The bogie of claim 12, in which the form of the surrounding mortise wall is slightly vaulted for absorbing driving and braking forces.

17. The bogie of claim 1, in which a first said line-contact support exists between said foot and further frame, and a second said line-contact support exists between said further frame and a said wheel frame wherein said first and second line-contacts each include end portions located laterally outboard beyond said wheels.

* * * * *

UNITED STATES PATENT OFFICE

CERTIFICATE OF CORRECTION

Patent No. 4 220 096 Dated September 2, 1980

Inventor(s) Alexandre Horowitz

It is certified that error appears in the above-identified patent and that said Letters Patent are hereby corrected as shown below:

Change the date of the Foreign Application Priority Data from "Oct. 21, 1977" to ---Feb. 21, 1977---.

Col. 6, line 17; change "Claim 8" to ---Claim 9---.

Col. 6, line 22; change "surface" to ---curved plane---.

Col. 6, line 36; change "Claim 10" to ---Claim 11---.

Col. 6, line 39; change "Claim 10" to ---Claim 11---.

Col. 6, line 43; change "Claim 10" to ---Claim 11---.

Col. 6, line 54; change "Claim 13" to ---Claim 14---.

Signed and Sealed this

*Twenty-fifth* Day of *November 1980*

[SEAL]

*Attest:*

SIDNEY A. DIAMOND

*Attesting Officer*

*Commissioner of Patents and Trademarks*